US005888717A

United States Patent [19]

Bergthaller et al.

[11] Patent Number: 5,888,717

[45] Date of Patent: Mar. 30, 1999

[54] PHOTOGRAPHIC SILVER HALIDE EMULSION

[75] Inventors: Peter Bergthaller, Bergisch Gladbach; Hans-Ulrich Borst, Elsdorf; Jörg Siegel, Leverkusen, all of Germany

[73] Assignee: Agfa-Gevaert AG, Germany

[21] Appl. No.: 970,488

[22] Filed: Nov. 14, 1997

[30] Foreign Application Priority Data

Nov. 20, 1996 [DE] Germany ..... 196 48 013.2

[51] Int. Cl.[6] ..... G03C 1/09

[52] U.S. Cl. ..... 430/567; 430/603; 430/604; 430/605; 430/612

[58] Field of Search ..... 430/567, 603, 430/604, 605, 612

[56] References Cited

U.S. PATENT DOCUMENTS

| | | | |
|---|---|---|---|
| 4,923,794 | 5/1990 | Sasaki et al. | 430/603 |
| 5,532,120 | 7/1996 | Yagihara et al. | 430/600 |
| 5,547,829 | 8/1996 | Kojima et al. | 430/603 |
| 5,667,958 | 9/1997 | Hioki et al. | 430/604 |
| 5,763,154 | 6/1998 | Gysling et al. | 430/603 |

FOREIGN PATENT DOCUMENTS

| | | | |
|---|---|---|---|
| 661 589 | 11/1994 | European Pat. Off. | G03C 1/09 |

*Primary Examiner*—Mark F. Huff
*Attorney, Agent, or Firm*—Connolly & Hutz

[57] ABSTRACT

A photosensitive silver halide emulsion which is ripened with at least one compound of the formula (I)

$$R_1—X—R_2 \quad (I)$$

in which $R_1$ and $R_2$ mutually independently mean groups which are linked to X via an element from periods 3 to 6 of main group 4 or 5 or via an element from sub-groups 4 to 8 of the periodic system of elements, wherein $R_1$ and $R_2$ may be attached together via a linking member and wherein the bonds $R_1$—X and $R_2$—X may mutually independently be single or double bonds, and X means Se or Te, is distinguished by elevated sensitivity, low grain and low fog.

9 Claims, No Drawings

PHOTOGRAPHIC SILVER HALIDE EMULSION

This invention relates to a photographic silver halide emulsion which is ripened with a novel ripening agent. This invention furthermore relates to a silver halide material containing a silver halide emulsion ripened in this manner.

The purpose of ripening silver halide emulsions is to increase the photosensitivity of silver halide emulsions without bringing about an increase in fog (c.f. *Ullmann's Encyclopedia of Industrial Chemistry,* volume A 20 (1992), pp. 36 et seq.). Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Many compounds and methods have already been proposed by means of which ripening may be performed. The best known ripening agents are gold and sulphur compounds, with sodium thiosulphate being an example of a sulphur compound. In order further to increase the sensitivity achieved therewith, it has been proposed that the sulphur compound be entirely or partially replaced by selenium compounds (EP-A 661 589). It has also been proposed that the sulphur compounds be replaced by certain tellurium compounds.

The increase in sensitivity achieved with known ripening agents is, however, inadequate for a range of applications. In particular, many known selenium and tellurium ripening agents bring about an increase in fog which is unacceptable for a range of products in which high sensitivity, low grain and low fog are required. This applies particularly to tabular silver halide emulsions.

The object of the invention was to remedy these disadvantages.

It has now been found that this object is achieved with novel selenium and tellurium ripening agents.

The present invention provides a photosensitive silver halide emulsion which is ripened with at least one compound of the formula (I)

$$R_1—X—R_2$$

in which $R_1$ and $R_2$ mutually independently mean groups which are linked to X via an element from periods 3 to 6 of main group 4 or 5 or via an element from subgroups 4 to 8 of the periodic system of elements, wherein $R_1$ and $R_2$ may be attached together via a linking member and wherein the bonds $R_1$—X and $R_2$—X may mutually independently be single or double bonds, and X means Se or Te.

The present invention also provides a photographic silver halide emulsion in which at least 50% of the projected surface area consists of tabular crystals having an aspect ratio of at least 3 and which is ripened with at least one ripening agent of the formula (I), particularly preferably a silver halide emulsion in which hexagonal tabular crystals constitute at least 70% of the projected surface area and which has an adjacent edge ratio in the range from 2:1 to 1:1.

Emulsions having a narrow grain size distribution are also preferred.

The distribution range of an emulsion is defined as:

$$V[\%] = \frac{\text{standard deviation of grain size distribution} \cdot 100}{\text{average grain size}}$$

V is preferably ≦30%, in particular ≦25%.

The compounds of the formula (I) are preferably used in a quantity of 2 to 500 mg/1000 g of Ag, in particular of 5 to 100 mg/1000 g of Ag and are in particular added during the time interval from the beginning of chemical ripening until the end of spectral sensitisation.

Chemical ripening may thus also be performed in the presence of the spectral sensitisers.

Suitable compounds of the formula (I) are:

I-Se1

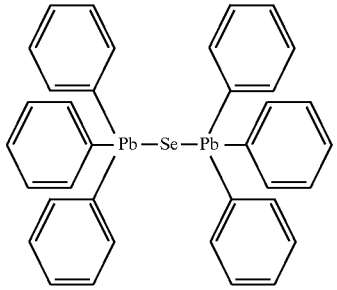

I-Se-2

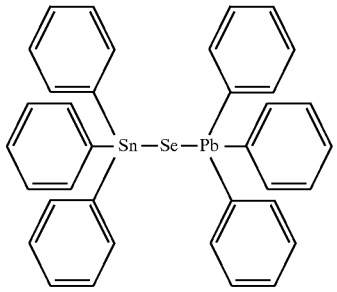

I-Se-3

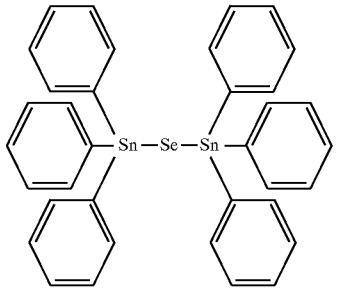

I-Se-4

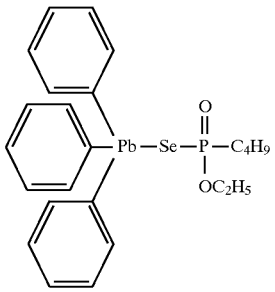

-continued
I-Se-5
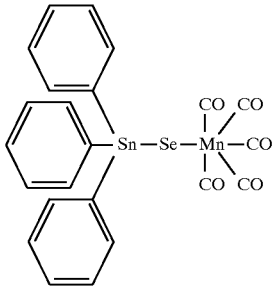
I-Se-6
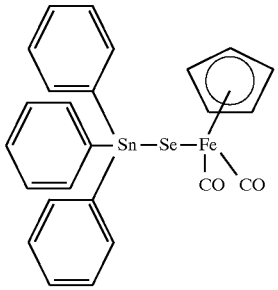
I-Se-7
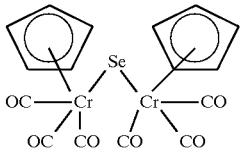
I-Se-8
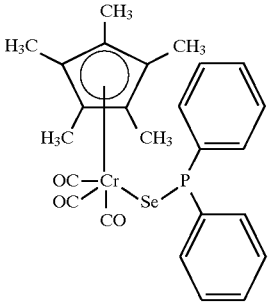
I-Se-9
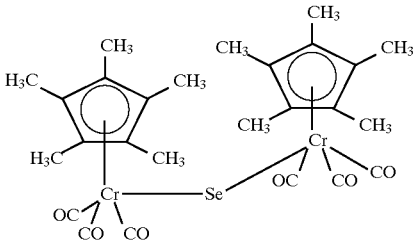
I-Se-10
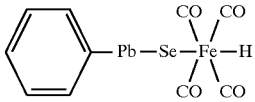
-continued
I-Se-11
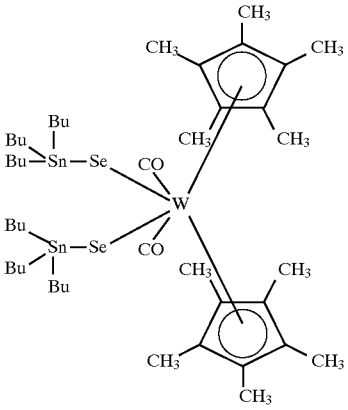
Bu = n-$C_4H_9$
I-Se-12
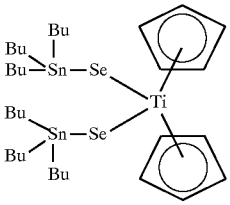
I-Se-13
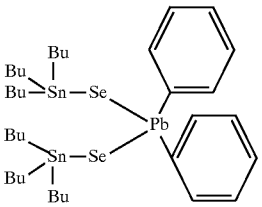
I-Se-14
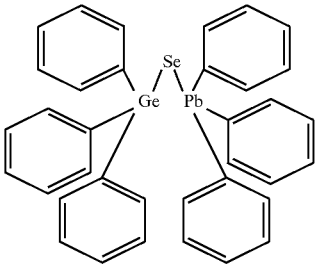
I-Se-15
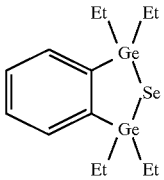
Et = $C_2H_5$
I-Se-16
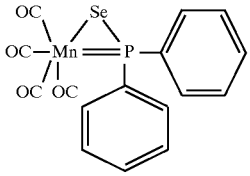

-continued
I-Se-17
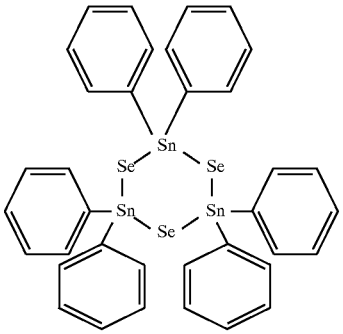
I-Se-18
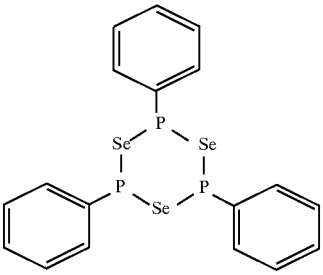
I-Se-19
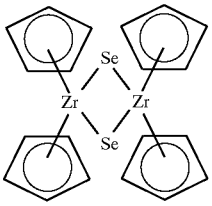
I-Se-20
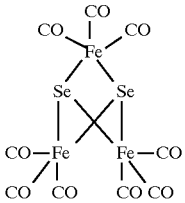
I-Te-1
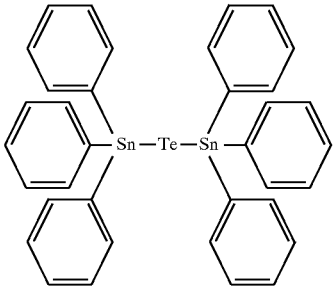
I-Te-2
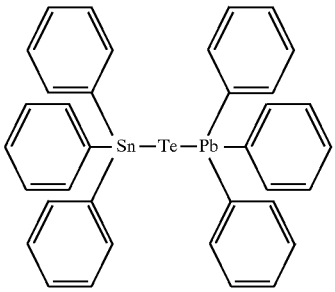
-continued
I-Te-3
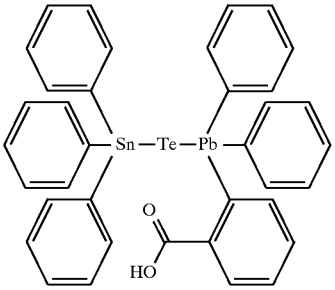
I-Te-4
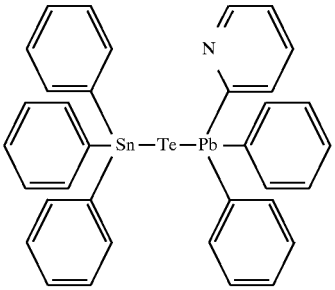
I-Te-5
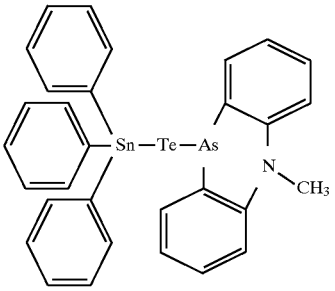
I-Te-6
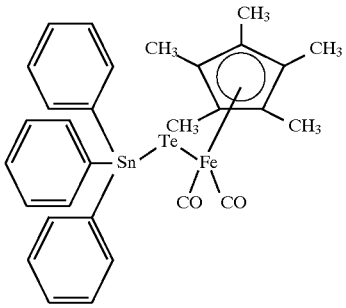
I-Te-7
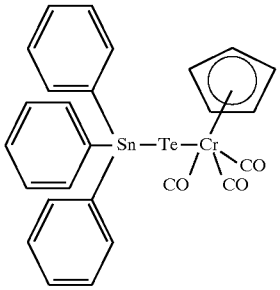

-continued
I-Te-8
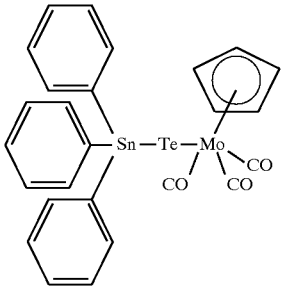
I-Te-9
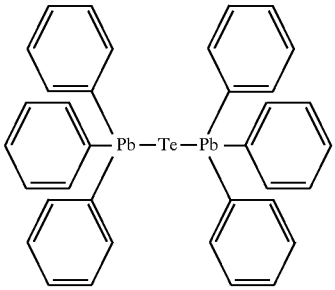
I-Te-10
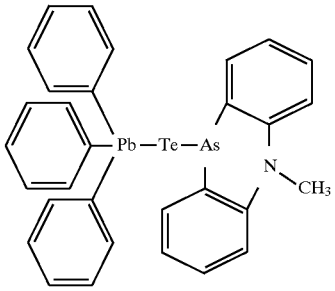
I-Te-11
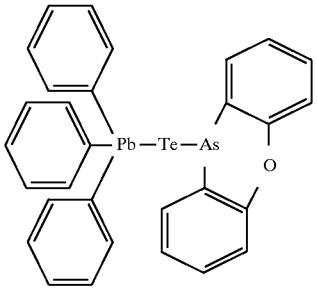
I-Te-12
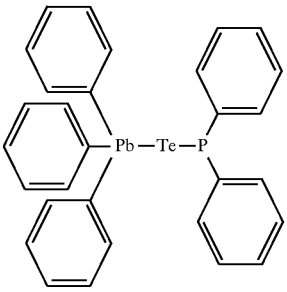
-continued
I-Te-13
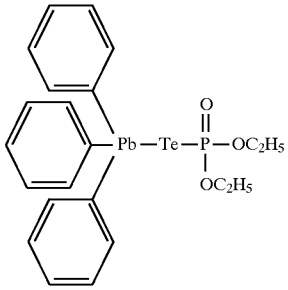
I-Te-14
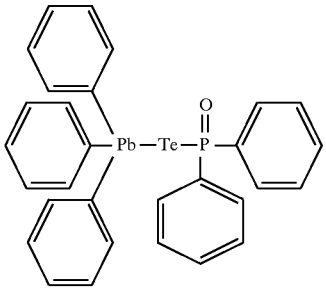
I-Te-15
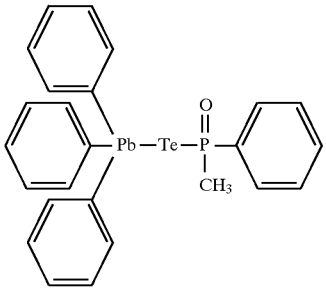
I-Te-16
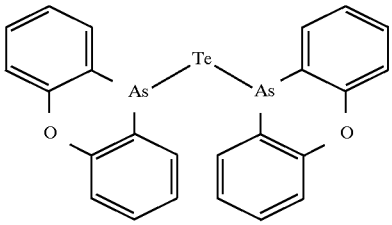
I-Te-17
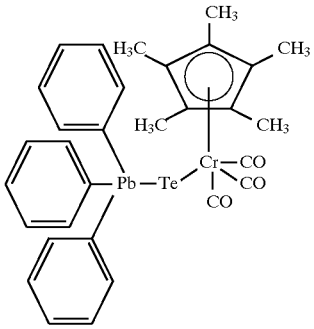

-continued

I-Te-18

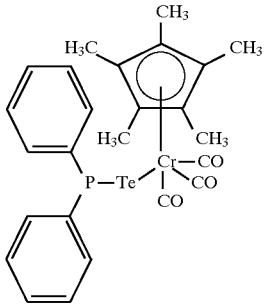

I-Te-19

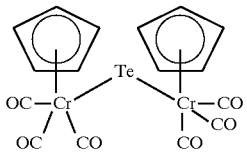

I-Te-20

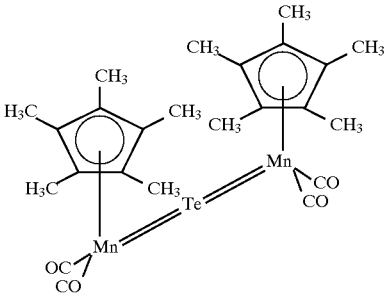

I-Te-21

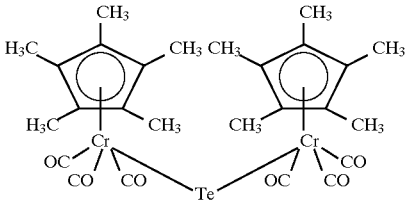

I-Te-22

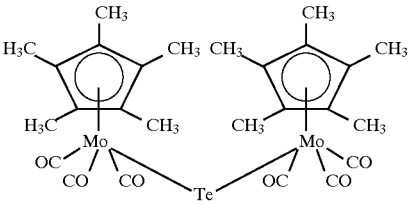

I-Te-23

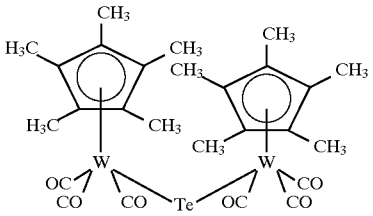

I-Te-24

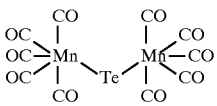

-continued

I-Te-25

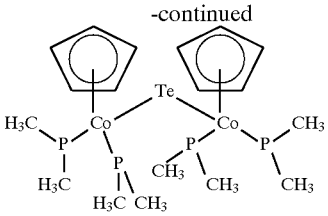

I-Te-26

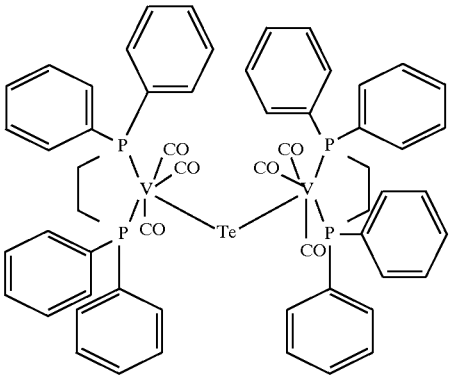

I-Te-27

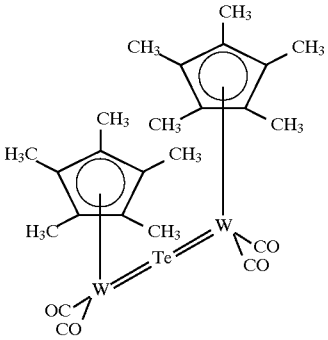

I-Te-28

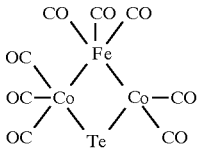

I-Te-29

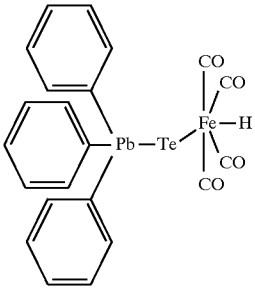

Production of the novel selenium and tellurium ripening agents has frequently been described in the literature, for example in:

Hieber, Gruber; Z. *Anorg. Chem.* 296, 91 (1958)

Schumann, Thom, Schmidt; *Angew. Chem.* 75, 138 (1963)

Schumann, Thom, Schmidt; *J. Organomet. Chem.* 2, 361 (1964)

Strouse, Dahl; *J. Am. Chem. Soc.* 93, 6032 (1971)

Einstein, Jones, Jones, Sharma; *Can. J. Chem.* 61, 2611 (1981)

Hofmann, Werner; *Angew. Chem.* 93, 1088 (1981)

Herberhold, Reiner, Neugebauer; *Angew. Chem.* 95, 46 (1983)

Klingert, Werner; *J. Organomet. Chem.* 252, C 47 (1983)

Schiemann, Hübener, Weis; *Angew. Chem.* 95, 1021 (1983)

Herrmann, Rohrmann, Schäfer; *J. Organomet. Chem.* 265, C 1 (1984)

Herrmann, Rohrmann, Ziegler, Zahn; *J. Organomet. Chem.* 273, 221–232 (1984)

Herrmann, Hecht, Ziegler, Zahn; *J. Organomet. Chem.* 273, 323–331 (1984)

Herrmann, Hecht, Ziegler, Balbach; *J. Chem. Soc. Chem. Commun.* 1984, 686

Herrmann, Rohrmann, Hecht; *J. Organomet. Chem.* 290, 53–61 (1985)

Albrecht, Hübener, Behrens, Weiss; *Chem. Ber.* 118, 4059–4067 (1985)

Lincoln et al.; *Inorg. Chem.* 24, 1355–9 (1985).

Compound I—Te—2 is obtained, for example, starting from triphenylstannyl chloride by reaction with 2 equivalents of lithium, insertion of a Te atom into the Sn–Li bond and reaction with triphenylplumbyl chloride.

In a particularly preferred embodiment, the silver halide emulsion is ripened in the presence of the selenium and/or tellurium compounds according to the invention together with conventional sulphur ripening agents. One particularly preferred sulphur ripening agent is sodium thiosulphate.

The ripened emulsions according to the invention may be stabilised in a known manner with heterocyclic NH or SH compounds, in particular with those having an acidic group, for example an —$SO_3H$ or —COOH group. The stabilisers are preferably added after spectral sensitisation and are selected such that they do not displace the sensitising dye or sensitising dyes from the silver halide crystals of the emulsion and moreover such that they do not inhibit bleaching of image silver during processing.

Suitable stabilisers are:

RST-1

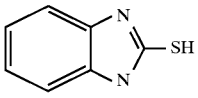

RST-2

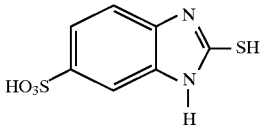

RST-3

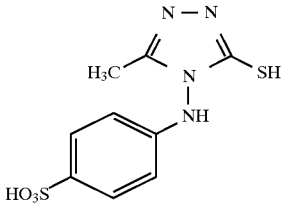

RST-4

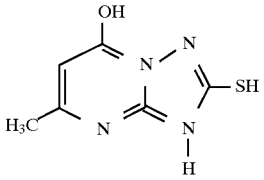

RST-5

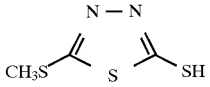

-continued

RST-6

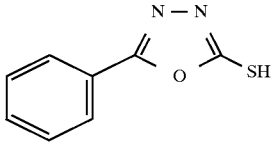

RST-7

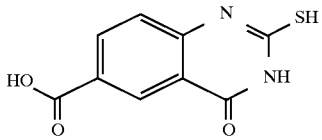

RST-8

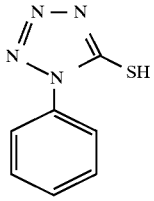

RST-9

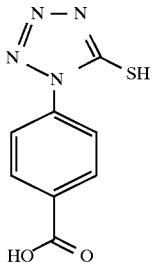

RST-10

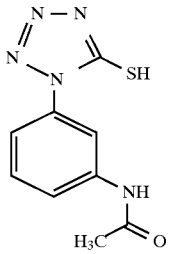

RST-11

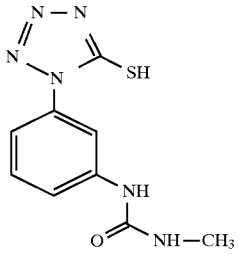

RST-12

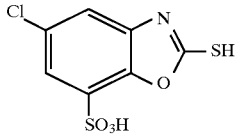

RST-13

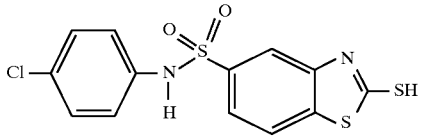

The compounds according to the invention are used as aqueous solutions, as organic solutions or as dispersions. Preferred organic solvents are water-miscible compounds, for example methanol, ethanol, isopropanol, tetrahydrofuran, phenoxy-ethanol or 3-hydroxypropionitrile.

Silver halide emulsions are taken to comprise not only those having silver halide crystals predominantly consisting of silver chloride, but also those having silver halide crystals predominantly consisting of silver bromide. Such emulsions are in particular taken to comprise those in which at least 80 mol. % of the silver halide consists of silver bromide and those which in particular have a silver iodide content of between 2 and 15 mol. %. The silver iodide content is preferably concentrated in the core zone of the silver halide crystal. The silver halide emulsion preferably consists of AgBrI or AgBrICl crystals containing up to 15 mol. % of iodide and/or up to 15 mol. % of chloride.

The present invention preferably provides silver halide emulsions which are ripened with gold and sulphur compounds and to which during the production thereof, at least one tellurium compound of the formula (I) has been added during chemical ripening.

Sulphur ripening is preferably performed with sodium thiosulphate as the ripening agent, but thioureas or isothiocyanates or thiophosphates may also be used as sulphur ripening agents.

Ripening with gold preferably proceeds with a combination of thiocyanate and gold(III) chloride or a tetrachloroaurate(III) salt, which is reduced to a gold(I) compound during the course of ripening.

The emulsions may additionally also contain other noble metal compounds as dopants, for example iridium(III), rhodium(III), platinum or palladium(III) compounds, in particular tetrachloropalladates(II), which are intended to improve long term stability. The emulsions may furthermore contain very small quantities of mercury compounds.

In order to reduce fog, the emulsions may moreover contain certain isothiazolone or isoselenazolone compounds or disulphides, polysulphides or diselenides.

Chemical ripening with gold and sulphur compounds and spectral sensitisation may also be performed separately or in a single stage.

The emulsions are in particular ripened at pH values of between 4 and 8 and at pAg values of between 6.5 and 9.

The emulsions produced according to the invention are suitable both for print materials and for recording materials, in particular for colour recording materials having camera sensitivity, for example for highly sensitive colour negative films and for colour reversal films. The emulsions produced according to the invention are also suitable for materials which contain a layer sensitised in the infra-red region of the spectrum.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the nature of the photographic material, these layers may be differently arranged. This is demonstrated for the most important products:

Colour photographic films such as colour negative films and colour reversal films have on the support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally arranged between the green-sensitive and blue-sensitive layers to prevent blue light from reaching the underlying layers.

Possible options for different layer arrangements and the effects thereof on photographic properties are described in *J. Inf. Rec. Mats.,* 1994, volume 22, pages 183–193.

Colour photographic paper, which is usually substantially less photosensitive than a colour photographic film, conventionally has on the support, in the sequence stated below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers, apart from the silver halide grains, are binders and colour couplers.

Details of suitable binders may be found in *Research Disclosure* 37254, part 2 (1995), page 286.

Details relating to colour couplers may be found in *Research Disclosure* 37254, part 4 (1995), page 288 and in *Research Disclosure* 37038, part 11 (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

In preferred compounds of the formula I, $R_1$ means

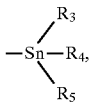

$R_2$ means

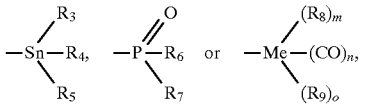

$R_3$, $R_4$, $R_5$ mutually independently mean alkyl or aryl, $R_6$, $R_7$ mutually independently mean alkoxy, alkyl or aryl, $R_8$ means cyclopentadienyl, $R_9$ means nitrosyl or thionitrosyl, Me means Ti, Zr, V, Cr, Mo, W, Mn, Fe, Co or Ni, m means 0, 1 or 2 n means 0, 1, 2, 3, 4 or 5 and o 0, 1 or 2, wherein the sum of m, n and o is at least 2.

EXAMPLE 1

Emulsion 1/1 a) Production of preliminary precipitate:

A solution of 110 g of inert gelatine and 42 g of potassium bromide in 7 kg of water was initially introduced with stirring. At 40° C., an aqueous silver nitrate solution (36 g of silver nitrate in 400 g of water) and an aqueous halide solution (26 g of potassium bromide in 400 g of water) were then apportioned as a twin in-flow within 120 seconds. 220 g of inert gelatine in 880 g of water were then added. After heating to 60° C., an aqueous silver nitrate solution (89 g of silver nitrate in 300 g of water) were then added within 4 minutes. The second twin in-flow was performed at 65° C., with an aqueous silver nitrate solution (150 g of silver nitrate in 900 g of water) and an aqueous halide solution (64 g of potassium bromide and 35 g of potassium iodide in 900 g of water) being apportioned within 8 minutes. During the inflow, the pBr value of 2.0 in the dispersion medium was held constant. After the final inflow, the emulsion was cooled to 25° C. and flocculated at pH 3.5 by addition of polystyrene-sulphonic acid (PSS) and then washed at 20° C. The flocculate was then made up to 11.5 kg with water and redispersed at pH 6.5 and a temperature of 50° C.

b) Production of emulsion with tabular grains:

The preliminary precipitate was melted and digested at 65° C. Once the pBr value had been adjusted to 1.7 with aqueous 2N KBr solution, an aqueous silver nitrate solution (1020 g of $AgNO_3$ and 2500 g of water) and an aqueous halide solution (607 g of KBr and 2500 g of water) were apportioned as a twin inflow within 15 minutes. The pBr value was maintained at 1.7.

After the final inflow, the emulsion was cooled to 25° C., flocculated at pH 3.5 by addition of polystyrene-sulphonic acid (PSS) and then washed at 20° C. The flocculate was redispersed at pH 6.5 and a temperature of 50° C. by the addition of 59 g of inert gelatine in 2600 g of water. Relative to the projected surface area of the crystals, over 80% of the AgBrI emulsion consisted of hexagonal, tabular crystals having a side length ratio of between 1.0 and 1.5 and an aspect ratio of 6. The median particle size by volume was 0.44 μm, the distribution range 19% and the iodide content 2.8%.

The emulsion was chemically ripened at 55° C., a pAg of 7.4 and a pH of 6.5 per mol of silver nitrate with 3.0 μmol of tetrachloroauric acid, 20 μmol of sodium thiosulphate and 690 μmol of potassium thiocyanate per mol of silver.

Emulsions 1/2 to 1/11 were ripened in a similar manner, but half the quantity of thiosulphate was replaced by a selenium or tellurium compound, see Table 1.

TABLE 1

| Emulsion | Ripening agent |
|---|---|
| Em-1/1 | 20 μmol $Na_2S_2O_3$ |
| Em-1/2 | 10 μmol $Na_2S_2O_3$ + 10 μmol compound Se-A |
| Em-1/3 | 10 μmol $Na_2S_2O_3$ + 10 μmol compound Se-B |
| Em-1/4 | 10 μmol $Na_2S_2O_3$ + 10 μmol compound Te-A |
| Em-1/5 | 10 μmol $Na_2S_2O_3$ + 10 μmol compound I-Se-1 |
| Em-1/6 | 10 μmol $Na_2S_2O_3$ + 10 μmol compound I-Se-3 |
| Em-1/7 | 10 μmol $Na_2S_2O_3$ + 10 μmol compound I-Se-7 |
| Em-1/8 | 10 μmol $Na_2S_2O_3$ + 10 μmol compound I-Te-1 |
| Em-1/9 | 10 μmol $Na_2S_2O_3$ + 10 μmol compound I-Te-9 |
| Em-1/10 | 10 μmol $Na_2S_2O_3$ + 10 μmol compound I-Te-13 |
| Em-1/11 | 10 μmol $Na_2S_2O_3$ + 10 μmol compound I-Te-27 |

The specimens were cast onto a cellulose triacetate film of 120 μm in thickness together with an emulsion of cyan coupler C-1, 4 mmol of 4-hydroxy-6-methyl-1,3,3a,7-tetraazaindene per mol of Ag and 80 μmol of 1-phenyl-5-mercaptotetrazole per mol of Ag at the following application rates per $m^2$:

4.0 g of emulsion (relative to $AgNO_3$), 3.0 g of gelatine, 0.8 g of cyan coupler C-1.

Once hardened and dried, the film specimens were exposed with daylight through a graduated grey wedge. The materials were then processed using the process described in *The British Journal of Photography* 1974, page 597. The sensitivity data relate to a density of 0.2 above fog. Relative values are stated, wherein the sensitivity of emulsion Em-1/1 was arbitrarily assigned a value of 100. The results are shown in Table 2:

TABLE 2

| Emulsion | Se/Te ripening agent | Sensitivity | Fog | |
|---|---|---|---|---|
| Em-1/1 | — | 100 | 0.25 | Comparison |
| Em-1/2 | Se-A | 115 | 0.36 | Comparison |
| Em-1/3 | Se-B | 110 | 0.30 | Comparison |
| Em-1/4 | Te-A | 125 | 0.31 | Comparison |
| Em-1/5 | I-Se-1 | 118 | 0.28 | Invention |
| Em-1/6 | I-Se-3 | 125 | 0.28 | Invention |
| Em-1/7 | I-Se-7 | 130 | 0.25 | Invention |
| Em-1/8 | I-Te-1 | 125 | 0.26 | Invention |
| Em-1/9 | I-Te-9 | 120 | 0.25 | Invention |
| Em-1/10 | I-Te-13 | 120 | 0.23 | Invention |
| Em-1/11 | I-Te-21 | 140 | 0.28 | Invention |

It is evident from Table 2 that the sensitivity/fog relationship may be distinctly improved with the ripening agents according to the invention.

Substances used in the Examples:

Se—A: Trispyrrolidinophosphane selenide

Se—B: Na-0,0-diethylselenophosphate

Te—A: Trispyrrolidinophosphane telluride

C-1

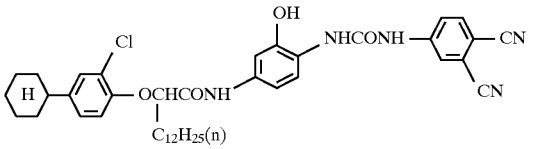

EXAMPLE 2

Emulsion 2/1

A silver bromide-iodide emulsion having an average grain diameter of a circle of identical area of 1.5 μm, a distribution range of V=23%, an aspect ratio of 7.5 and an average iodide content of 9 mol. % is ripened to optimum sensitivity with 2 μmol of tetrachloroauric acid, 250 μmol of potassium thiocyanate and 10 μmol of sodium thiosulphate per mol of $AgNO_3$ and then sensitised with 300 mg of a mixture of the red sensitisers RS-1, RS-2 and RS-3 in a ratio by weight of 3:6:1 respectively.

Emulsions 2/2 to 2/10 are produced in the same manner, but the quantity of sodium thiosulphate is reduced to 4 μmol and 5 μmol of the ripening agent stated in Table 3 are additionally used.

After addition of a colour coupler emulsion of the following composition, emulsions 2/1 to 2/10 are applied onto a subbed cellulose triacetate support of a thickness of 120 μm:

Cyan coupler C-1: 0.3 g/m$^2$

Gelatine: 0.7 g/m$^2$

Tricresyl phosphate (TCP): 0.45 g/m$^2$

Emulsion (g $AgNO_3$): 0.85 g/m$^2$.

The layer is then hardened with the following hardening layer:

Hardener H-1: 0.02 g/m$^2$

Gelatine: 0.01 g/m$^2$.

The specimens were exposed with daylight through an orange filter and a graduated grey wedge and then processed using the process described in *The British Journal of Photography* 1974, page 597. The sensitivity data are determined in relative DIN units at a density of 0.2 above $D_{min}$. The sensitivity of emulsion Em-1/1 is arbitrarily assigned a value of 100.

The results are shown in Table 3:

| Emulsion | Ripening agent Invention/Comparison | | Sensitivity log.I.t | Fog $D_{min}$ |
|---|---|---|---|---|
| 2/1 | — | Comparison | 100 | 0.30 |
| 2/2 | I-Se-1 | Invention | 125 | 0.28 |
| 2/3 | I-Se-3 | Invention | 120 | 0.33 |
| 2/4 | I-Se-7 | Invention | 130 | 0.32 |
| 2/5 | I-Te-1 | Invention | 125 | 0.31 |
| 2/6 | I-Te-9 | Invention | 140 | 0.35 |
| 2/7 | I-Te-13 | Invention | 125 | 0.33 |
| 2/8 | I-Te-21 | Invention | 135 | 0.31 |
| 2/9 | Se-A | Comparison | 135 | 0.38 |
| 2/10 | Te-A | Comparison | 120 | 0.45 |

It is evident from the Examples that a better sensitivity/fog relationship is obtained with the selenium and tellurium ripening agents according to the invention.

Hardener H-1:

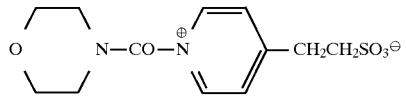

RS-1:

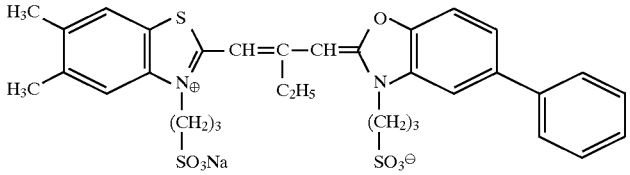

RS-2:

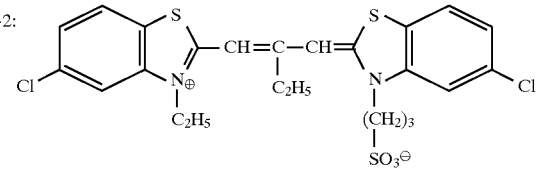

-continued

RS-3

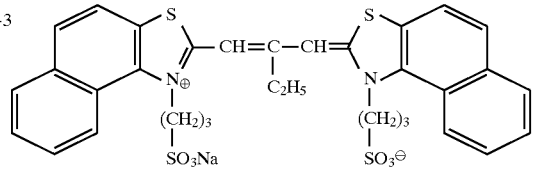

EXAMPLE 3

Emulsion 3/1

The following solutions are prepared:

Solution 1: 7000 ml of deionised water 600 g of gelatine 1.0 g of 1-(3,6-dithiaoctyl)urea Solution 2: 7000 ml of deionised water 1300 ml of sodium chloride Solution 3: 7000 ml of deionised water 3000 g of silver nitrate Solutions 2 and 3 are simultaneously added with vigorous stirring to solution 1 over a period of 120 minutes at 60° C. and at a pAg of 7.7. A cubic silver chloride emulsion having an average particle diameter of 0.90 μm is obtained. The distribution range V is 17%. The gelatine to silver ratio is 0.18. In a known manner, the emulsion is flocculated with PSS, washed and redispersed with such a quantity of gelatine that the gelatine/silver ratio is 0.56. The emulsion contains 1 mol of silver chloride per kg.

The emulsion is then optimally ripened at 60° C. at a pH of 4.5 with 3.5 μmol of $KAuCl_4$ and 1.5 μmol of $Na_2S_2O_3$ per mol of Ag.

After chemical ripening, the emulsion is spectrally sensitised with 300 μmol of blue sensitiser BS-1 and stabilised with 280 μmol of 1-(3-acetarninophenyl)-5-mercaptotetrazole.

Emulsions 3/2 to 3/6 differ in that only 1.5 μmol of $KAuCl_4$ and 0.5 μmol of $Na_2S_2O_3$ and additionally 2.0 μmol of the ripening agent stated in Table 4 are used.

The emulsions are combined with a yellow coupler emulsion and cast onto a paper coated on both sides with polyethylene:

Yellow coupler emulsion:

0.63 g of $AgNO_3/m^2$ 1.38 g of gelatine/$m^2$ 0.29 g of TCP/$m^2$ 0.95 g of yellow coupler Y-1/$m^2$.

The material is hardened by application of a protective layer prepared from 0.2 g of gelatine and 0.3 g of hardener H-1 per $m^2$. Specimens thereof are exposed with an image through a graduated wedge and processed using the Ektacolor RA-4 process.

The sensitometric results are shown in Table 4:

TABLE 4

| Emulsion | Ripening agent | | $D_{min}$ | log.I.t | $\gamma_1$ | $\gamma_2$ |
|---|---|---|---|---|---|---|
| 3/1 | — | Comparison | 0.107 | 1.708 | 1.67 | 3.69 |
| 3/2 | Se-A | Comparison | 0.304 | 1.800 | 1.62 | 2.69 |
| 3/3 | Te-A | Comparison | 0.435 | 1.378 | 1.22 | 2.40 |
| 3/4 | I-Se-2 | Invention | 0.112 | 1.793 | 1.70 | 3.50 |
| 3/5 | I-Te-2 | Invention | 0.111 | 1.788 | 1.70 | 3.55 |
| 3/6 | I-Te-19 | Invention | 0.119 | 1.895 | 1.65 | 3.35 |

The results show that elevated sensitivity (log I.t), low fog ($D_{min}$) and steep gradation ($\gamma_1$ and $\gamma_2$) are obtained only with the ripening agents according to the invention.

Y-1

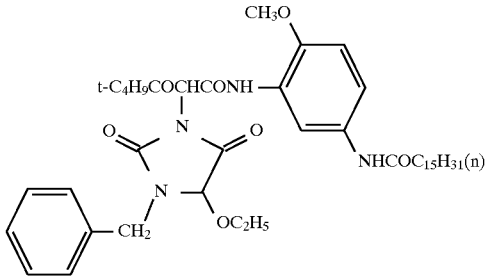

BS-1

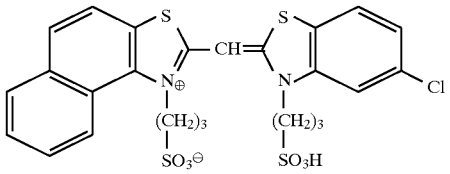

We claim:

1. Photographic silver halide emulsion which is ripened with at least one compound of the formula (I)

$$R_1—X—R_2$$

in which $R_1$ and $R_2$ mutually independently mean groups which are linked to X via an element from periods 3 to 6 of main group 4 or 5 or via an element from subgroups 4 to 8 of the periodic system of elements, wherein $R_1$ and $R_2$ may be attached together via a linking member and wherein the bonds $R_1$—X and $R_2$—X may mutually independently be single or double bonds, and X means Se or Te.

2. The photographic silver halide emulsion according to claim 1, wherein at least 50% of the projected surface area consists of tabular crystals having an aspect ratio of at least 3.

3. The photographic silver halide emulsion according to claim 1, wherein at least 70% of the projected surface area consists of hexagonal tabular crystals having an aspect ratio of at least 3, the adjacent edge ratio of which is in the range from 2:1 to 1:1.

4. The photographic silver halide emulsion according to claim 1, wherein the compounds of the formula (I) are used in a quantity of 2 to 500 mg/1000 g of Ag of the silver halide emulsion.

5. The photographic silver halide emulsion according to claim 1, wherein it is stabilized with an acidic heterocyclic NH or SH compound.

6. The photographic silver halide emulsion according to claim 1, in which $R_1$ means

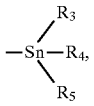

$R_2$ means

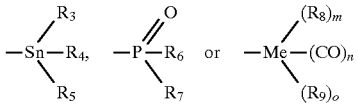

$R_3$, $R_4$and $R_5$ mutually independently mean alkyl or aryl, $R_6$ and $R_7$ mutually independently mean alkoxy, alkyl or aryl, $R_8$ means cyclopentadienyl, $R_9$ means nitrosyl or thionitrosyl, Me means Ti, Zr, V, Cr, Mo, W, Mn, Fe, Co or Ni, m means 0, 1 or 2 n means 0, 1, 2, 3, 4or 5 and

O 0, 1 or 2, wherein the sum of m, n and o is at least 2.

7. The photographic silver halide emulsion according to claim 1, wherein the compounds of formula (I) are used in a quantity of 5 to 100 mg/1000 g of Ag of the silver halide emulsion.

8. The photographic silver halide emulsion as claimed in claim 1, wherein the compounds of formula I are selected from the group consisting of

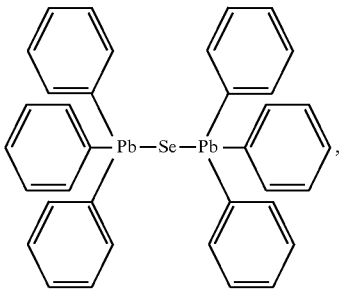

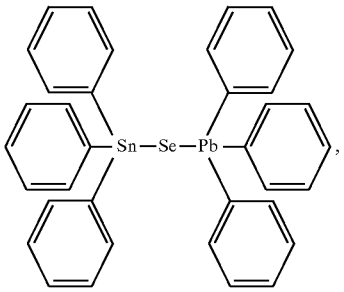

-continued

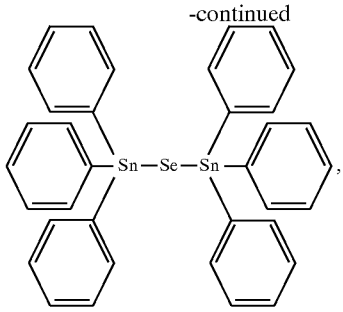

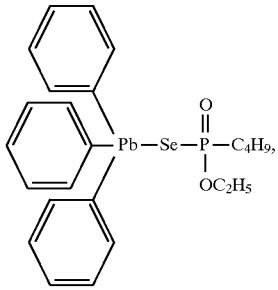

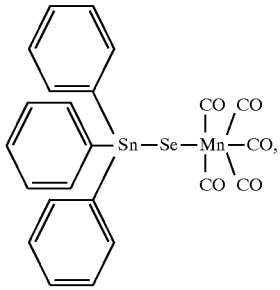

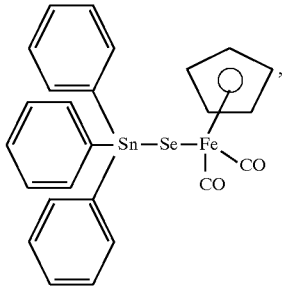

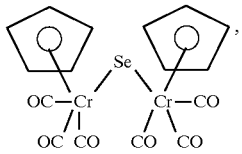

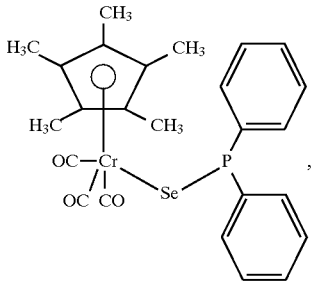

-continued
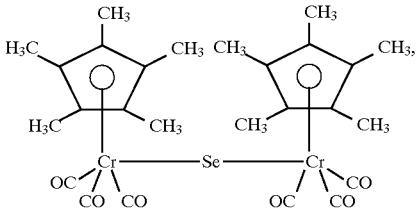
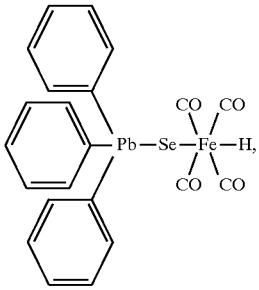
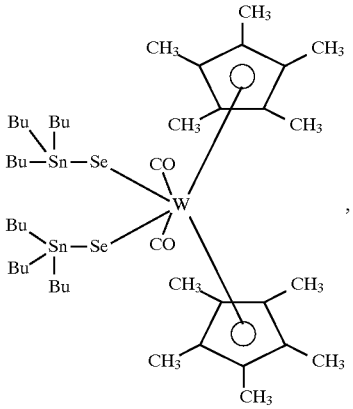
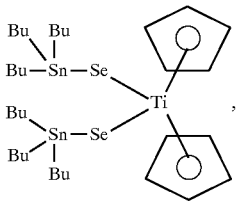
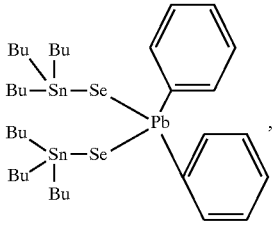
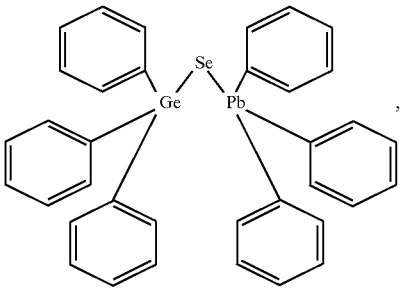
-continued
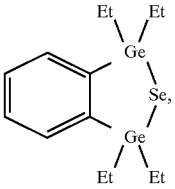
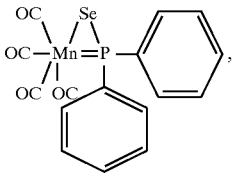
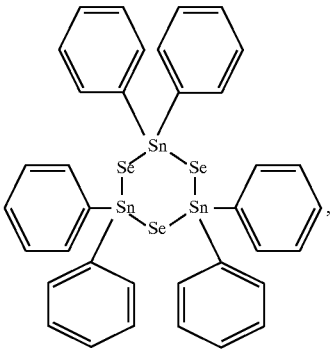
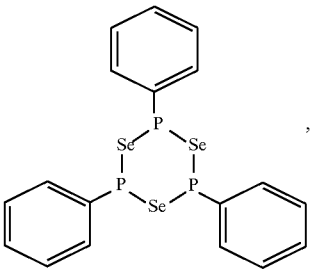
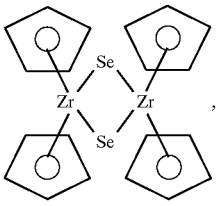
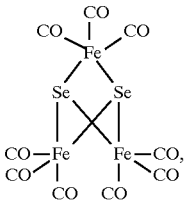

-continued
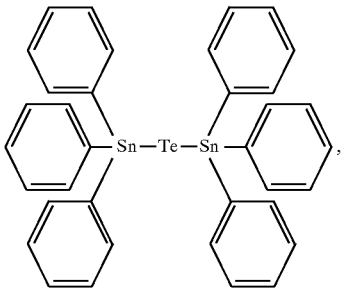
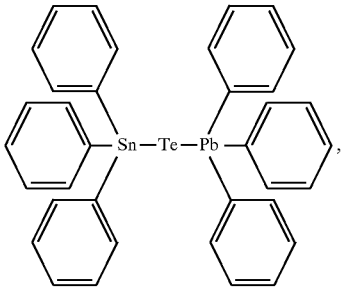
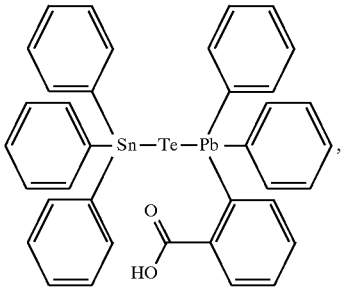
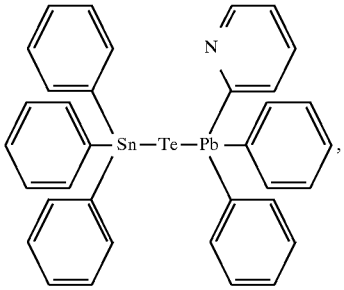
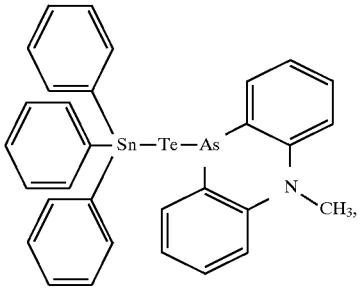
-continued
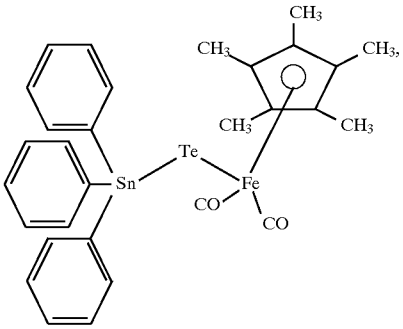
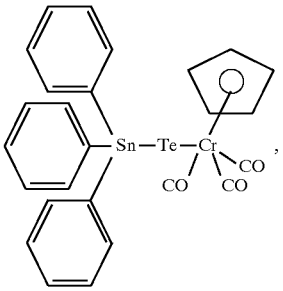
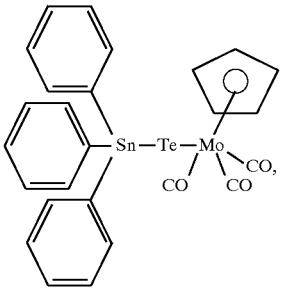
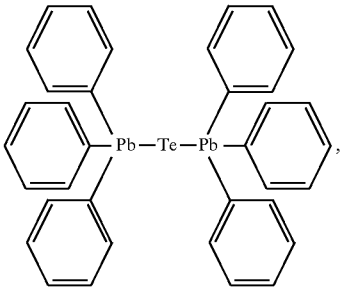
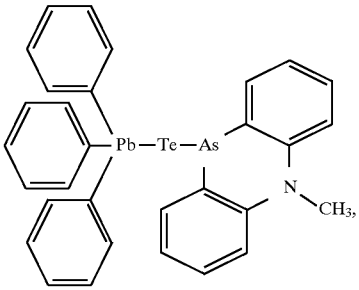

-continued
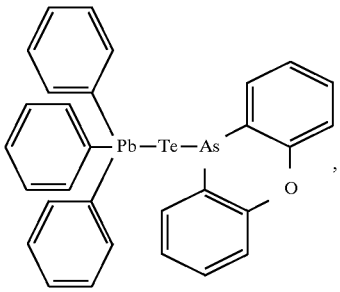
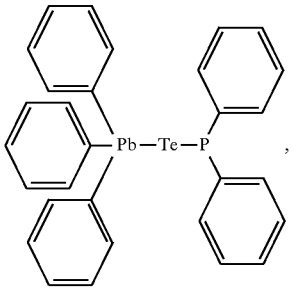
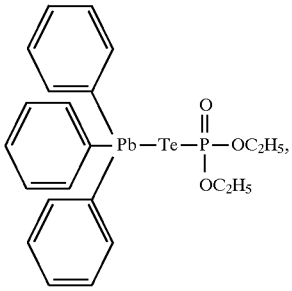
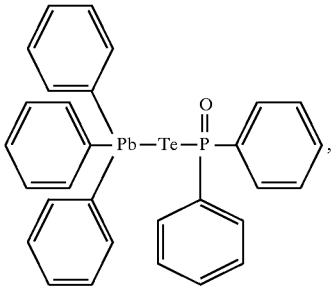
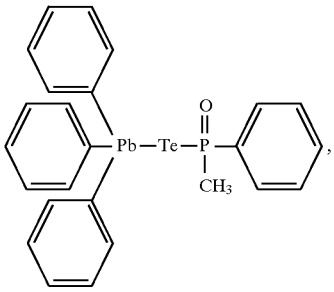
-continued
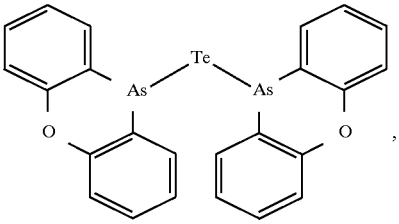
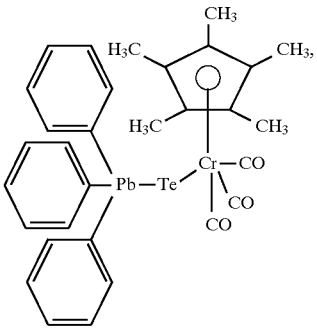
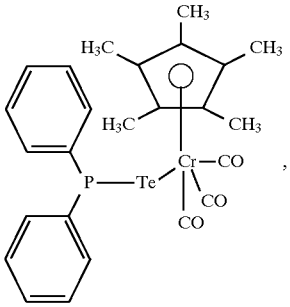
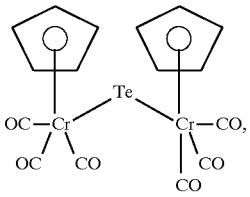
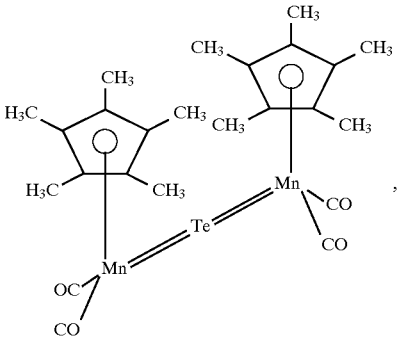
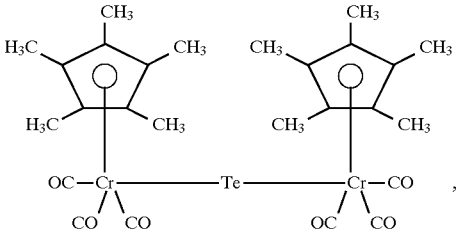

-continued
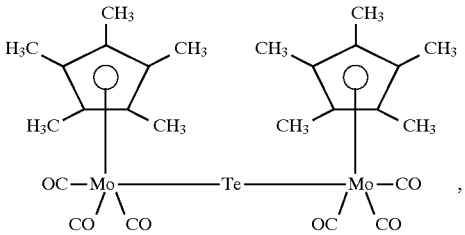
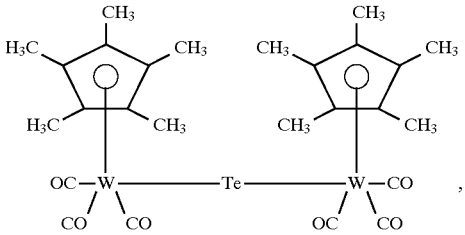
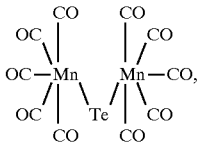
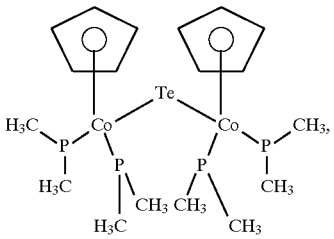
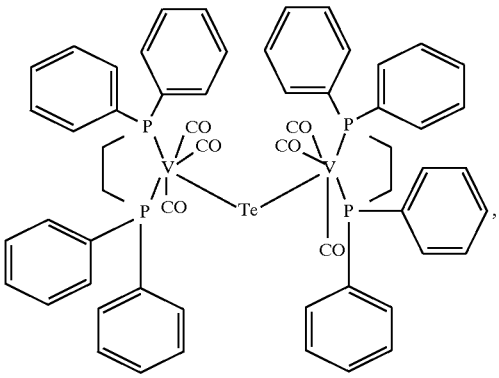
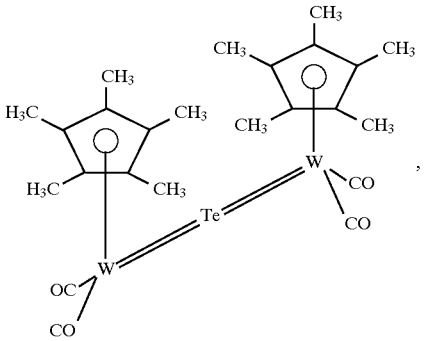
-continued
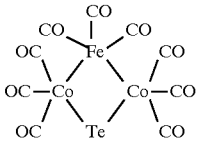
and
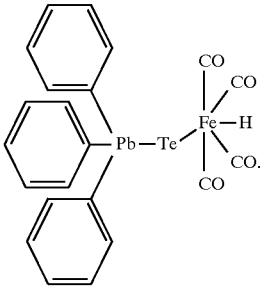
9. The photographic silver halide emulsion according to claim 1, which is stabilized with a stabilizer selected from the group consisting of
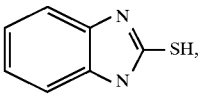
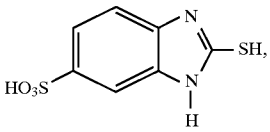
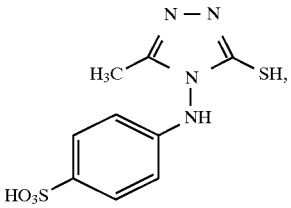
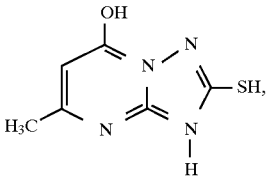
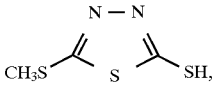
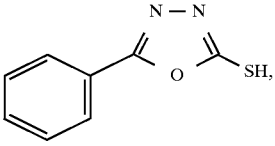
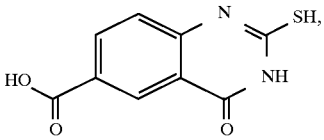

-continued
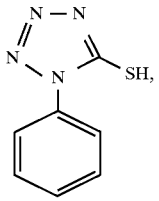
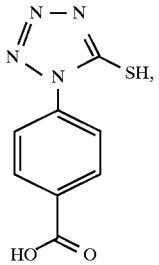
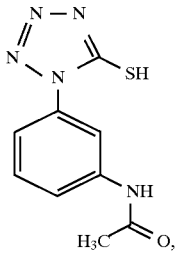
-continued
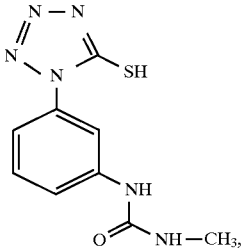
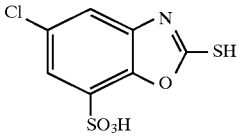
and
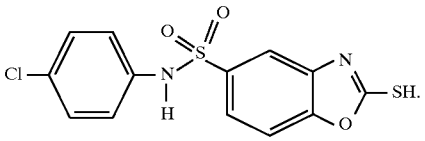
* * * * *